United States Patent [19]

Bustamante

[11] Patent Number: 4,477,180

[45] Date of Patent: Oct. 16, 1984

[54] PHOTOCONDUCTOR ADVANCE SYSTEM FOR COPIERS AND THE LIKE

[75] Inventor: Louis A. Bustamante, Longmont, Colo.

[73] Assignee: International Business Machines Corporation, Armonk, N.Y.

[21] Appl. No.: 453,205

[22] Filed: Dec. 27, 1982

[51] Int. Cl.[3] ..... G03G 15/00

[52] U.S. Cl. ..... 355/14 R; 355/3 DR; 355/3 BE; 355/14 CU

[58] Field of Search ..... 355/3 R, 3 DR, 3 BE, 355/14 R, 14 C, 14 CU, 16; 242/67.3 R, 55.19 R, 55.19 A

[56] References Cited

U.S. PATENT DOCUMENTS

| | | | |
|---|---|---|---|
| 3,358,570 | 12/1967 | Morrill et al. | 355/14 C UX |
| 3,588,242 | 6/1971 | Berlier et al. | 355/16 |
| 3,944,360 | 3/1976 | Deetz et al. | 355/14 C |
| 3,984,241 | 10/1976 | Schrempp et al. | 96/1 |
| 4,097,138 | 6/1978 | Kingsley | 355/3 DR |
| 4,231,652 | 11/1980 | Moser et al. | 355/3 DR |
| 4,239,375 | 12/1980 | Eisbein et al. | 355/16 |
| 4,332,465 | 6/1982 | Steury | 355/14 R |

OTHER PUBLICATIONS

IBM Series III Copier/Duplicator Service Manual, Form No. 241-5928-0, Mar. 1976, pp. 6, 7, 9, 25-28.

*Primary Examiner*—A. C. Prescott

*Attorney, Agent, or Firm*—Gunter A. Hauptman; Earl C. Hancock

[57] ABSTRACT

Photoconductor panels are automatically replaced in an electrophotographic copier or printer after it is determined that the panels require replacement and the machine has entered into a run-out mode. The run-out mode is defined as the time period at the end of a copy processing operation between the transfer of the last image to a copy sheet and the final processing of that copy sheet by the machine. The photoconductor panel is completely replaced without interrupting machine operation and in a manner transparent to the user. A control circuit or process interprets the machine states to determine presence of the run-out mode.

13 Claims, 9 Drawing Figures

PHOTOCONDUCTOR ADVANCE SYSTEM FOR COPIERS AND THE LIKE

BACKGROUND OF THE INVENTION

1. Field of the Invention

This invention relates to electrophotographic apparatus and methods wherein the photoconductor material is periodically replaced. More particularly, the present invention relates to automatic replacement of photoconductor material in a web form in the environment of electrostatic copiers and printers. The invention is especially useful in that it allows automatic replacement of photoconductor panels in the imaging zone of copiers/-printers in a manner that is transparent to the user, while not detracting from the machine throughput.

2. Description of the Prior Art

Contemporary xerographic copiers/printers in some cases include webs of photoconductor material that are automatically replaced in the image area of the machine by mechanisms internally to the machine. For instance, the IBM Series III Copier/Duplicator has a pair of supply spools, each containing a roll of photoconductor material which exits through drum seals onto two separate peripheral areas of the photoconductor drum. These flexible photoconductor webs each return to the inside of the drum through yet another drum seal and are attached to take-up spools. An internal gearing arrangement is attached to each take-up spool and is selectively actuable by a clutch configuration. Thus, the drum with the photoconductor normally stays in place and rotates with the drum in its imaging and image transferring operations, while the panel replacement is periodically accomplished by actuation of the clutch to engage the drive for the gears. The take-up rolls are rotated for a distance adequate to allow replacement of the panels on the drum periphery with a sensor associated with the amount of photoconductor thus dispensed causing termination of the panel replacement operations.

The quality of copies produced from the photoconductor material deteriorates for any of several different reasons. For instance, the photoconductor has a certain life associated with its usage, and it is known that the imaging area panel requires replacement at some time associated with the end of that life. The photoconductor occasionally also is damaged or scratched and requires replacement. Thus, some present copiers include arrangements for automatically feeding a new photoconductor panel to the imaging area after a predetermined copy count is reached, although they often further include the ability to allow this incrementing if the servicing personnel determine that such replacement is necessary.

In prior art copiers/printers having selectively operable mechanisms for dispensing photoconductor web, the actual photoconductor panel replacement in the image area is essentially performed by one of two processes. For instance, the copying process is interrupted and dummy machine operations performed after a predetermined copy count is reached as is taught in U.S. Pat. No. 3,588,242 filed Jan. 15, 1969 by R. A. Berlier and R. W. Rice. The disadvantage of this approach is the machine is not available to the user during the panel replacement operations. This is especially inconvenient if the interruption occurs in the middle of a copy/print job. Occasionally, operators are unaware of the function underway and remove main power from the machine believing that a malfunction has occurred.

The other approach is to periodically advance small amounts of photoconductor after a copying operation is completed so that the image area photoconductor panel is effectively exchanged in increments. This is suggested in U.S. Pat. No. 3,984,241 filed Nov. 5, 1974 by E. Schrempp and H. S. Hazelton, Jr. The disadvantage of such systems is that the complete photoconductor panel is not replaced and the quality of copying in different areas of the photoconductor differs as a function of the age of the photoconductor areas.

The present invention overcomes the disadvantages of the prior art photoconductor panel replacement systems by advantageously employing the drum rotation during its run-out phase instead of interrupting the copy job or incrementally changing the photoconductor. In this application, the "run-out" phase is considered the time between transfer of the last image from the photoconductor to a copy sheet, and the time that the machine is finally shut down at the end of the run, as when the last copy sheet is completely processed and delivered to an output such as an exit tray or the like.

DISCLOSURE OF THE INVENTION

This invention relates to electrophotographic machines having a photoconductor web mounted so that a panel thereof establishes an image area for transferring images to copies, and where such machine further includes means for advancing successive panels of that web into the image area. Whenever a means from whatever source indicates that the panel in the image area requires replacement, a means detects the presence of the run-out interval commencing with completion of image transfer from the image area and extending for at least the time for last copy to exit from the machine. In response to the presence of this run-out interval and the indication that the photoconductor panel requires replacement, the structure within the machine is actuated for causing successive panel advancing into the image area thereby replacing the photoconductor panel without disrupting machine operation and without causing variations in photoconductor quality across the image area.

The present invention can further include means for terminating operation of the successive panel advancing when the new panel is in place in the image area. In the preferred embodiment, this panel replacement sensing is effected by a follower roller that essentially measures the amount of photoconductor web dispensed.

Typically, the indication that the photoconductor panel requires replacement is based upon a count of the number of copies made on a given web panel in the image area of the machine. Whenever this copy count is equal to or greater than a predetermined count such as 20,000 copies or the like, the indication is produced that the panel requires replacement.

A safeguard feature of the present invention is that the timing associated with the actual advancement of the web is monitored so that an indication of a failure to properly advance is produced if the advancing mechanism is actuated for an excessive period of time.

An advantage of the present invention is that it is well suited for implementation using digital circuitry and controlling microprocessors or computers associated with the xerographic machine. Furthermore, it requires minimal modification to existing photoconductor web storage and dispensing apparatus and is compatible with normal machine operation of the existing electrophotographic machines.

Those having normal skill in the art will readily recognize the foregoing and other objects, features, advantages, and applications of the present invention in light of the following more detailed description of the exemplary preferred embodiment as illustrated in the accompanying drawings.

DETAILED DESCRIPTION OF THE PREFERRED EMBODIMENT

Figure 1:
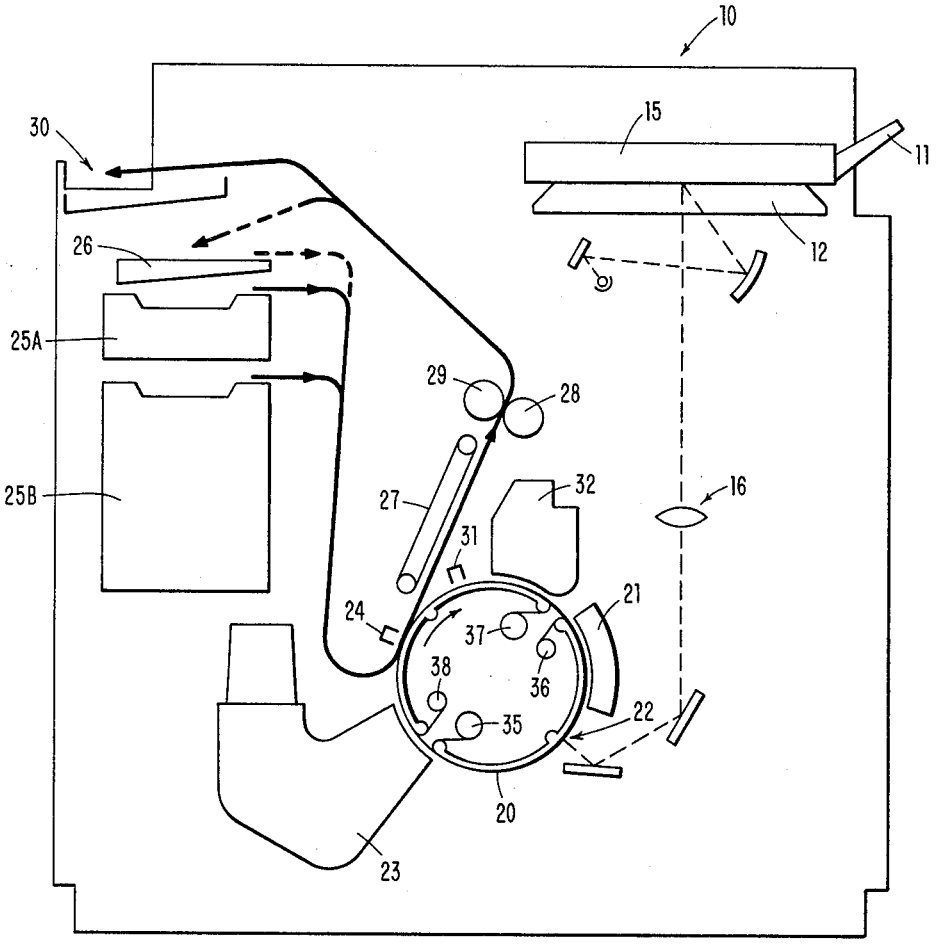
FIG. 1 is a somewhat schematic view of a typical xerographic copier in which the present invention is useful.

An exemplary embodiment of a copier 10 in which the present invention is useful is shown in FIG. 1 and is patterned after the IBM Series III Copier/Duplicator. Original documents are introduced either through a semi-automatic document feed at input tray 11, or are placed directly on document glass 12 by raising document feed housing 15. The documents are held in place while the optic system, shown generally at 16, scans the document and produces an image on drum 20 at image station 22.

As is known, photoconductor panels on drum 20 are charged by corona 21 and, after imaging at 22, the image is developed by toner application from developer 23. The image is then transferred to copy sheets by transfer corona 24, these copy sheets originating from either of dual supply drawers 25A and 25B or from duplex tray 26. The copy sheet with the transferred toner is carried by vacuum belt transport 27 to the nip of hot roll 28 and backup roll 29 where the image is fused on the paper. Ultimately, the copy sheet is delivered to exit pocket 30.

After the image is transferred, the photoconductor is cleaned by discharging at clean corona 31 and the excess toner removed at cleaner station 32. Thus, the machine shown operates as a single-cycle copying operation.

Drum 20 internally contains a spool 35 having a roll of flexible photoconductor web wrapped thereon with this web extending outwardly through a drum seal onto the exterior peripheral surface of drum 20 and ending on take-up reel 36, thereby defining one imaging area panel. A similar photoconductor web supply spool 37, and take-up spool 38 establishes the second photoconductor image panel on the peripheral surface of drum 20.

In the context of the FIG. 1 example, the run-out interval is the time following the last image transfer at transfer corona 24 to a copy sheet and the time that this copy sheet is finally deposited in exit pocket 30. During this interval, the main drive motor continues to run and the photoconductor drum 20 rotates. During this run-out period, various signals and controls are generated by the controller or controlling microprocessor as are discussed in conjunction with the present invention later herein.

Figure 2:
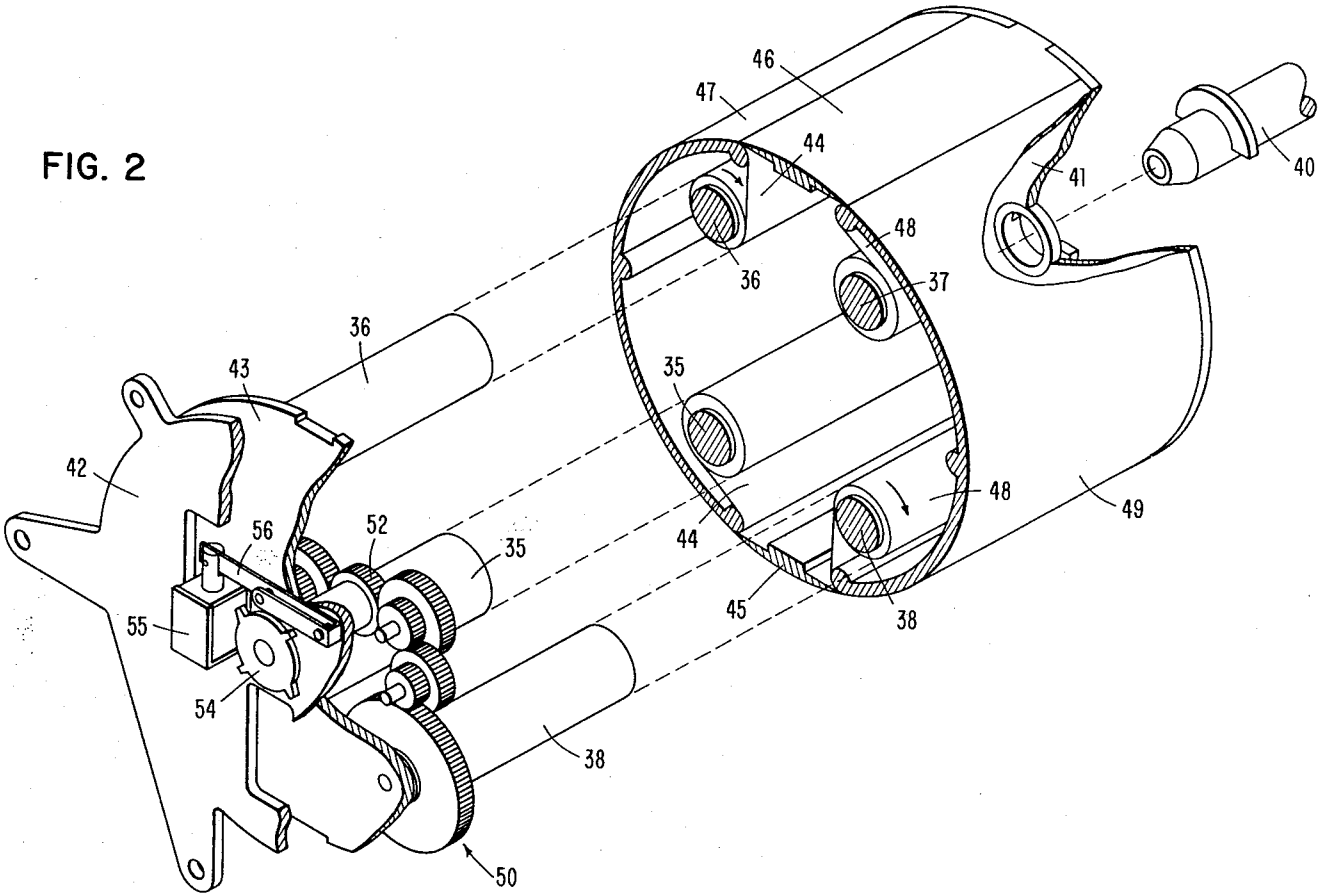
FIG. 2 is a partially sectioned and broken isometric view of typical mechanisms associated with dispensing photoconductor relative to a drum in the FIG. 1 machine.

FIG. 2 is a partially sectioned and broken isometric view of the typical drum configuration in FIG. 1. The photoconductor dispensing apparatus is somewhat similar to that shown in U.S. Pat. No. 3,588,242 by Berlier and Rice, although dual supply/take-up spools are incorporated within drum 20 as contrasted to Berlier et al. The main drive motor (not shown) is coupled to input drive shaft 40 which is keyed to end face 41 to normally rotate drum 20. The opposite end of drum 20 is rotatably attached to plate 42 which is fixed relative to the main machine frame.

Supply spool 35 has a web of photoconductor 44 wound thereon which passes outwardly through the gap in drum seal 45 to extend around the outer periphery of drum 20 and return through the gap at upper drum seal 46 to take-up reel 36. This establishes the first image area panel shown generally at 47. A second flexible web of photoconductor 48 is wound on supply spool 37 and exits through the other external gap of drum seal 46 to extend around the peripheral surface of drum 20 and enters through the second gap of drum seal 45 to take-up reel 38. This establishes the second photoconductor image area panel 49. Spools 35–38 are rotatably mounted to drum end plates 41 and 43.

A gear train 50 is coupled to one end of take-up spools 36 and 38 and gear train 50 ultimately meshes with a central gear 52. This gear is coupled through a bearing mount, or the like, to tooth clutch element 54. In normal operation, plate 54 and thus gear 52 and gear train 50 rotate with the drum and no change in state of the photoconductor webs 44 and 48 results. However, selection of solenoid 55 causes arm 56 to engage plate 54 to prevent it from rotating, thus causing rotary power to simultaneously couple to take-up spools 36 and 38. As a result, the web is pulled from supply spools 35 and 37 across the photoconductor image area panels 47 and 49 onto the take-up spools 36 and 38. This permits photoconductor panel replacement and in the prior art systems is operated either by a separate set of copy machine cycle operations or is effected by slowly incrementing sections of photoconductor as the machine is operated.

Also included internally to drum 20, but not shown, is a roller which engages the surface of webs 44 or 48 as it moves from the supply spool to the take-up spool so as to sense the physical amount of web thus dispensed. Typically, such a follower roller measures the photoconductor dispensing by actuating a switch after a certain amount of roller movement has transpired. Also a drag brake is associated with each supply spool 35 and 37 to maintain tension on photoconductors 44 and 48 as it is dispensed. These brakes are also not shown.

Figure 3:
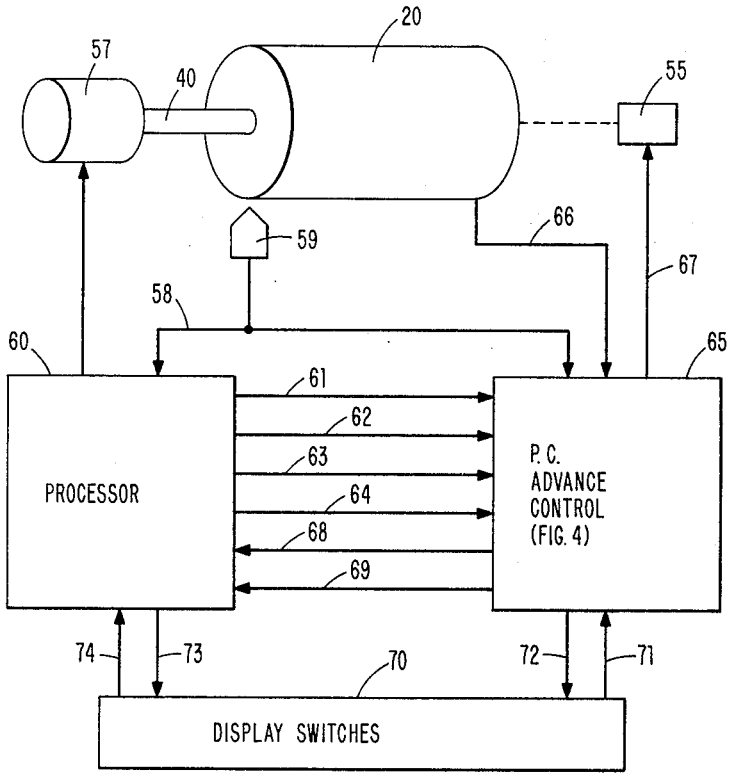
FIG. 3 is a general block diagram illustrating the interrelationship of the controlling electronics and the elements of the copier shown in FIGS. 1 and 2.

FIG. 3 illustrates the general interrelationship of the copier elements thus far described relative to the controls associated with this invention. Motor 57 provides mechanical drive 40 to drum 20. Timing pulses or sync pulses over output 58 from sensor head 59 are produced by a cam and microswitch assembly, optical emitter, magnetic emitter, or the like. Processor 60, including a microprocessor and appropriate programming, responds to the pulses at 58 to determine controls of various electrophotographic elements associated with copier operation as is conventional.

Processor 60 also produces a multiplicity of output signals 61–63 to photoconductor advance control circuit 65, described below in greater detail in conjunction with FIG. 4. Processor 60 maintains a count of the number of copies run for a particular photoconductor panel on drum 20, and raises a signal on line 61 (hereinafter ADVFLG) indicating that replacement of the photoconductor panel is required. Processor 60 also produces an output on line 62 referred to as CONV and an output on line 63 indicating a RUN condition, both of which are described later. Processor 60 also provides a power-on-reset (POR) input 64 to control circuit 65. Control circuit 65 provides a successful photoconductor (PC) advance signal 68 or a photoconductor advance failure signal 69 to processor 60.

A panel of displays and switches 70 provides a reset push button (RESET PB) input 71 to advance control 65, while control circuit 65 provides a lamp driver signal over line 72 to display a PC advance failure for the user. Processor 60 has multiple interface connections 73 and 74 for conventional cooperation with displays and switches 70.

The measuring device associated with photoconductor dispensing within drum 20 provides input signals over line 66 to control circuit 65, while the solenoid 55 drive signal is produced at output line 67. Essentially, PC advance control circuit 65 interprets the state of various input signals over lines 58, 61–64 and 66 to determine proper actuation of solenoid 55 so that the photoconductor advance occurs during the run-out phase without interrupting normal machine operation.

Figure 4:
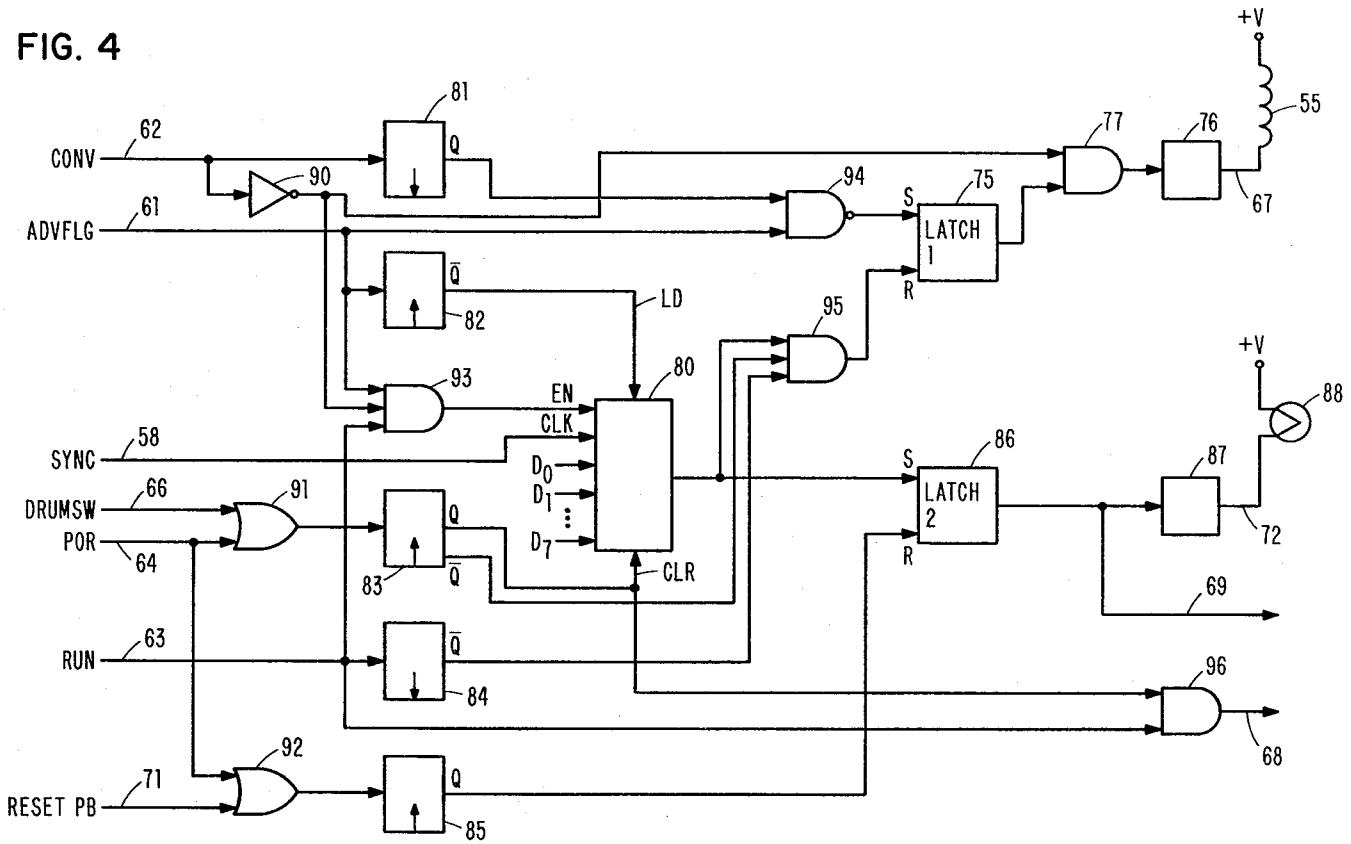
FIG. 4 is a more detailed circuit diagram of the photoconductor advancing controls shown generally in FIG. 3.

FIG. 4 is a circuit diagram of PC advance control circuit 65. The CONV signal 62 is a logical output from processor 60 that controls the magnetic gate power supply relay that drives electromagnets associated with developer 23. Processor 60 generates the CONV signal when the last image was transferred to a copy sheet from photoconductor drum 20, thus defining the beginning of the run-out interval. As mentioned, ADVFLG signal 61 is activated when processor 60 has counted a predetermined minimum number of copies performed by copier 10. This counter preferably occupies nonvolatile memory within processor 60 so that its contents are retained if machine power is lost and the state of ADVFLG is maintained. RUN signal 63 is a signal that corresponds to the time that main drive motor 57 is on in response to control signals from processor 60. SYNC signal 58 is an input generated by emitter wheel sensor 59 typically for each half drum 20 revolution. POR signal 64 is generated after proper voltage levels at the machine power supply outputs are established following a power-up sequence. DRUMSW signal 66 is the drum switch signal or feedback signal from the PC advance metering device that controls the duration of the advance cycle by signaling when the new photoconductor has replaced the old PC in the image area panel. RESET PB signal 71 is a push-button signal used to reset the advance failure indicator output 72.

Although generation of the ADVFLG signal 61 is more typically in response to a predetermined copy count sensing, this signal can originate from other criteria including manual override by the user, failure sensing in automatic diagnostics associated with the machine reflecting unacceptable photoconductor quality, or the like. The ADVFLG signal gates setting of latch 75 so as to activate the photoconductor advancing magnet driver 76 through AND 77. ADVFLG also enables hardware counter 80 which monitors drum revolutions while the photoconductor is advanced.

Since circuit 65 is intended to advance PC during run-out cycles, the FIG. 4 circuit must determine that the ADVFLG signal is present and the machine is in its run-out cycle, the time in which the machine is routing final copies of a job out of the paper path. In the FIG. 1 copier, run-out begins when the last latent image is developed, and ends when the main drive motor 57 is stopped. The operation of the FIG. 4 circuit is best understood in conjunction with the time-based diagrams of FIGURES 5–8.

Figure 5:
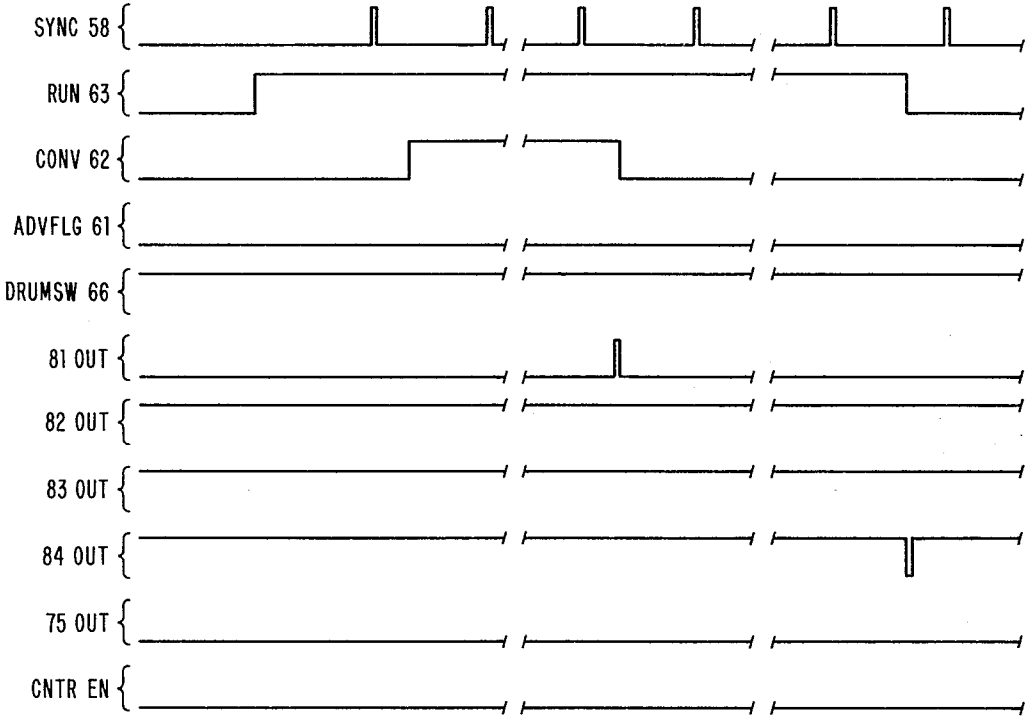
FIGS. 5–8 are time-based diagrams illustrating typical operating interrelationships of the components shown in FIG. 4.

The timing chart of FIG. 5 shows an output pulse produced from each of single shot circuits 81 and 84. Single shot circuit 81 interprets the change of CONV 62 to the inactive state corresponding to the last latent image development to produce an output signal that essentially reflects the start of run-out. Single shot circuit 84 responds to the loss of the RUN 63 signal to indicate that the run-out has ended since by definition the inactive RUN signal means the main drive motor has stopped. Note that the Q output of single shot 81 is gated (NANDED) with ADVFLG to provide the set input to latch 1 circuit 75, which is the PC advance magnet 55 controller. Even though single shot 81 output occurs with every negative transition of CONV, latch 1 circuit 75 is not set as long as the number of copies made on the present PC panel is less than the preselected number; i.e., processor 60 has not yet set ADVFLG 61.

Figure 6:
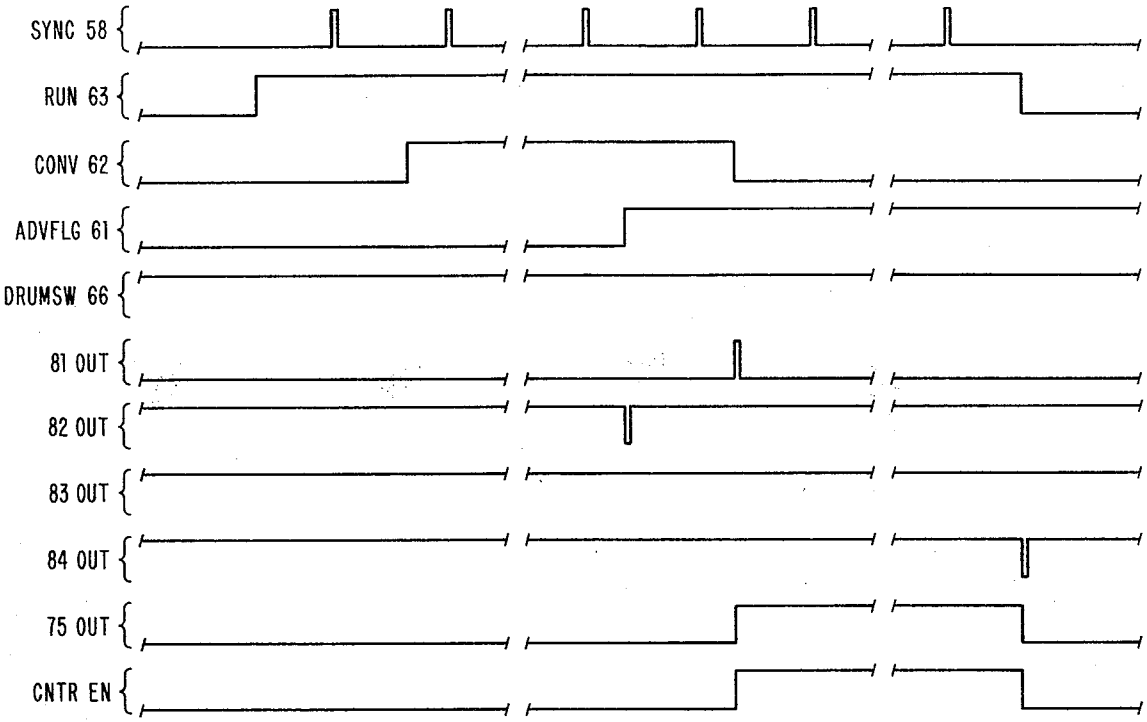

Eventually, ADVFLG 61 is activated as shown in FIG. 6. Here the $\overline{Q}$ output of single shot circuit 82 generates the load input LD of an eight-bit hardware counter 80 when the positive transition of ADVFLG 61 occurs. This programs counter 80 with the preset value dictated by the data input lines Do–D7. Since ADVFLG 61 remains active until a successful PC advance operation is completed or until the machine is powered down, latch 1 circuit 75 is set and reset every run-out thereafter. Note that counter 80 is enabled by AND 93 during the run-out period which is defined as the conjunction of not-CONV, ADVFLG and RUN. Hardware counters as well as volatile or nonvolatile software counters are suitable for counter 80.

It is possible after CONV 62 goes inactive to start a second copy job but before the copier 10 stops. Since latch 75, is set by the negative transition of CONV 62 if ADVFLG is active, it never resets in response to the negative transition of RUN since the machine is not stopping between jobs. If the output of latch 75 is introduced directly to the magnet driver 76, PC advancing during the second job would result. To prevent this, the output of latch 75 is gated (ANDED) with not-CONV as shown for AND 77. This assures that even though latch 75 is set, magnet driver 76 is not activated unless CONV is inactive. PC advance occurs at run-out of the final job. Inverter 90 ensures that the input for AND 77 of CONV 62 is of appropriate polarity.

Figure 7:
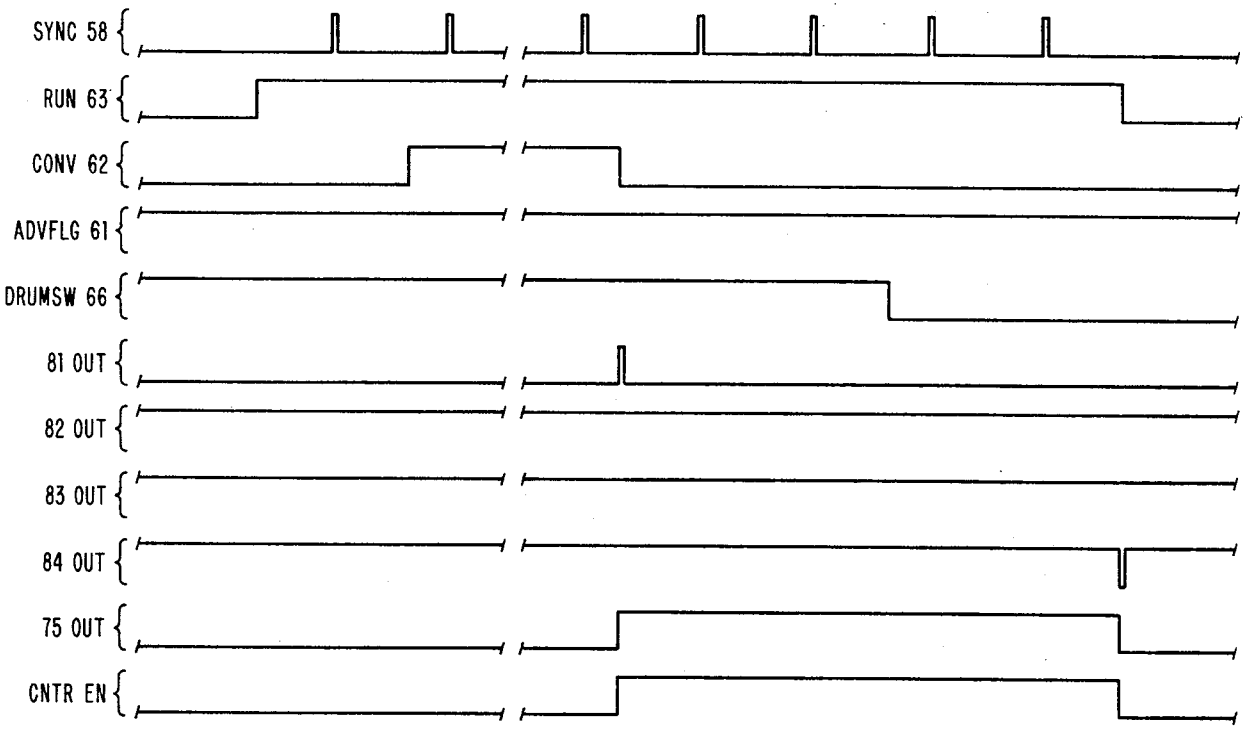
Figure 8:
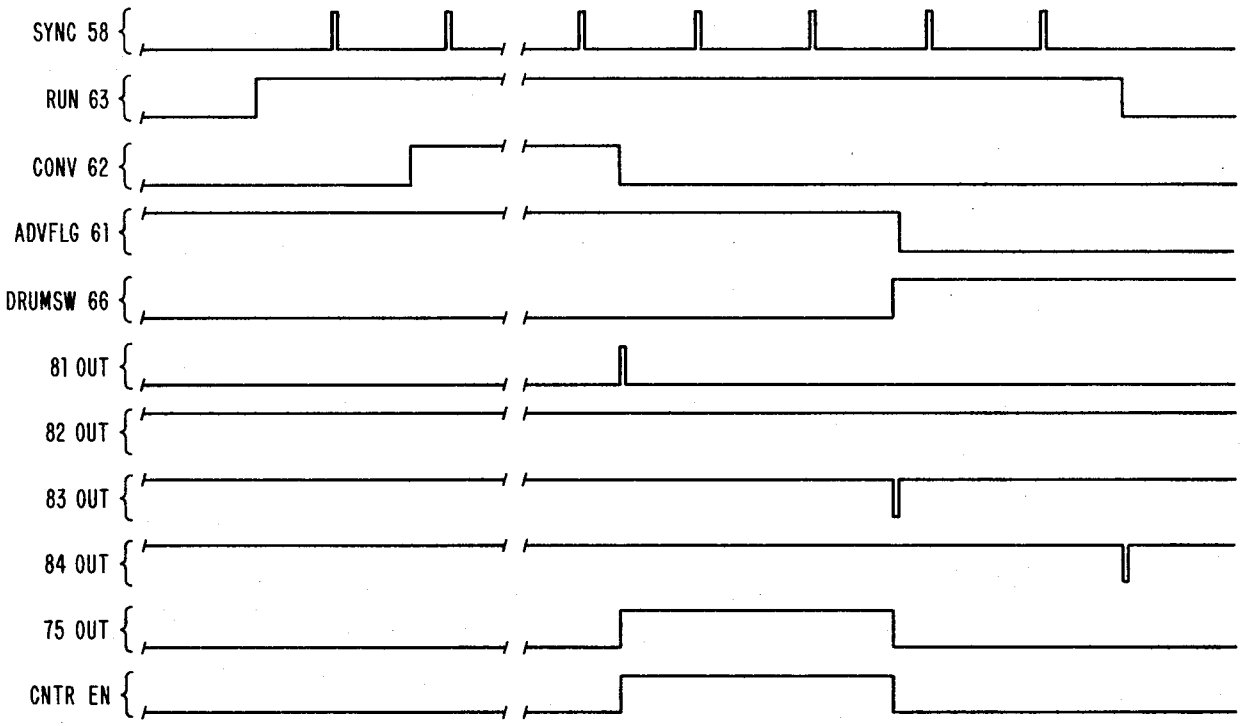

Counter 80 counts SYNC 58 pulses while the PC advance magnet 55 is activated. Under normal conditions, the drum switch that is part of the PC advance metering device internally to drum 20 signals that an appropriate end of advance has occurred by raising input DRUMSW 66 long before counter 80 counts out. The timing chart of FIG. 7 shows DRUMSW 66 going active (high to low). However, it is not until DRUMSW 66 returns to a high level that the magnet latch 75 is reset. That is, the Q and $\overline{Q}$ outputs of single shot circuit 83 reset counter 80 and latch 75, respectively, upon a positive transition of DRUMSW 66 signal. This is shown in the fourth timing chart, FIG. 8.

If the eight-bit counter 80 reaches a predetermined count level before DRUMSW 66 indicates successful PC advancement across the entire image area panel, a failure is presumed. The output pulse from counter 80 resets magnet latch 75 and sets the second latch, circuit 86. This energizes lamp driver 87 and failure indicator 88 in the user available display/switch panel 70 as well as providing a failure status indication to the processor over line 69. The preset number for the counter is selected to take into account the worst case photoconductor dispensing in association with the diameter variance on the spools in drum 20.

Processor 60 is informed of the success of the photoconductor advance cycle by a signal on line 68 which results from the concurrence of the RUN 63 signal and clearance of single shot circuit 83 in response to the DRUMSW 66 signal. If successful, processor 60 resets the software counter and resets ADVFLG. The successful advance signal 68 occurs only if the Q output of single shot 83 occurs when the machine is running. Although a positive transition of the POR signal 64 will produce a Q output at single shot 83, the machine is not running during a power-up sequence and thus it does not produce an erroneous successful advance signal 68.

In the event of a power-down situation, the latches and counters are reset when power is restored as reflected by the presence of POR signal 64. POR 64 also starts the processor 60. Processor 60 can determine that, if the number of copies in nonvolatile memory is greater than the predetermined count, the machine was performing a photoconductor advance operation when power was lost. Accordingly, upon restoration of power, the ADVFLG signal is reissued by processor 60. This reprograms SYNC 58 counter 80 and allows photoconductor advance to resume on run-out once again. Since the PC measuring device is a mechanical roller and switch combination, the proper amount of PC is dispensed despite this interruption.

Figure 9:
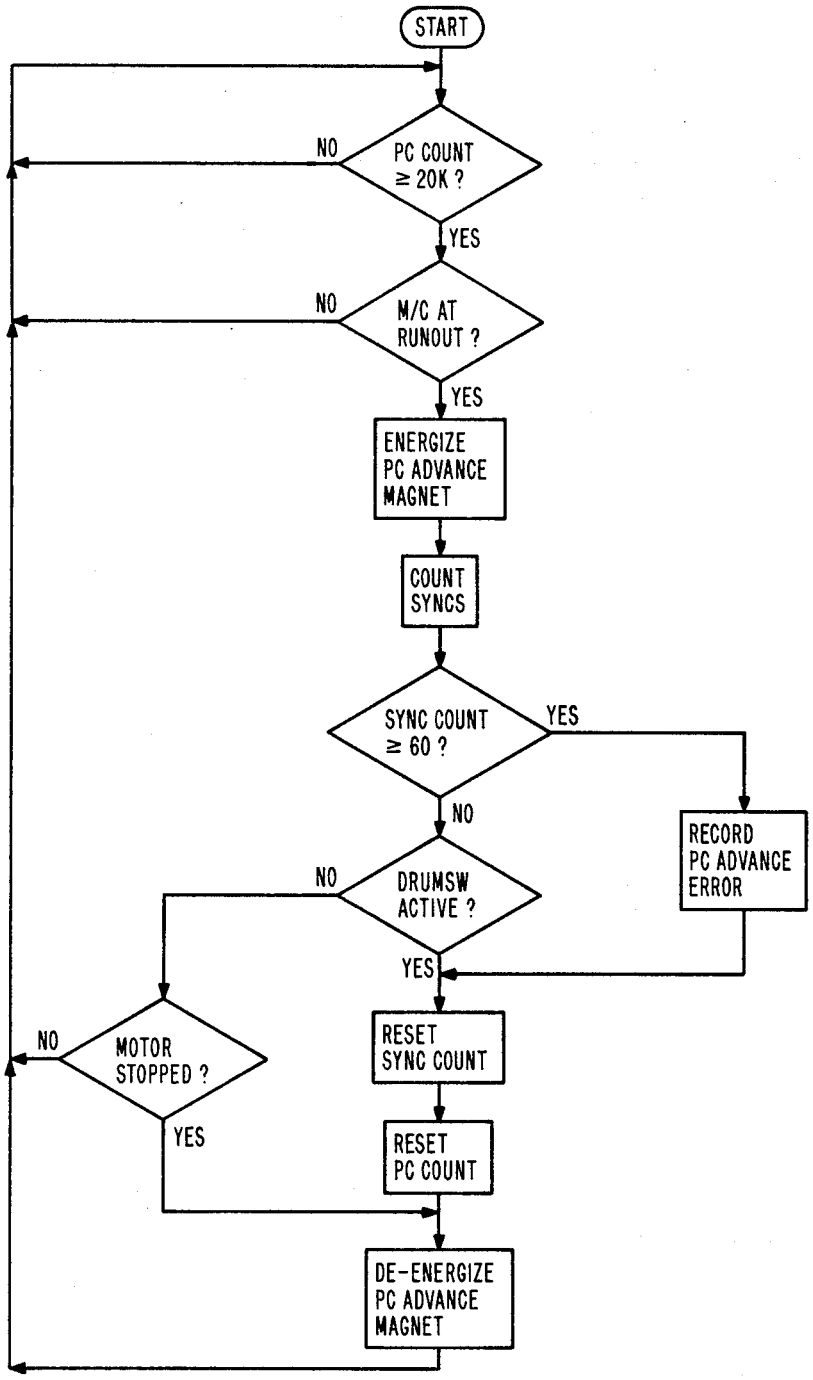
FIG. 9 is a flowchart of the typical control process associated with the present invention.

FIG. 9 is a flowchart of the process associated with the present invention. For purposes of this example, it is assumed that a copy count of 20,000 indicates need for replacement of the photoconductor panel and that a count of 60 in counter 80 is representative of more than enough time to complete a photoconductor panel replacement under worst conditions. In this example, the worst case is where the outer diameter of the PC on the take-up roll is minimum thereby requiring the maximum number of take-up spool revolutions to replace a complete PC panel. In FIG. 9, M/C means machine and "PC CNT" means photoconductor count or the count of the number of copies performed on the given photoconductor panel on drum 20. FIG. 9 is self-explanatory and essentially summarizes in process sequence the operation of the circuitry previously described.

Although the present invention is described herein with particularity relative to the foregoing detailed description of an exemplary embodiment, various modifications, changes, additions, and applications of the present invention in addition to those mentioned herein will readily suggest themselves to those having normal skill in the art without departing from the spirit of this invention.

What is claimed is:

1. In an electrophotographic machine having a photoconductor web mounted so that a panel thereof establishes an image area for transferring images to copies, and means for advancing successive panels of said web into said image area, the improvement comprising:

means for indicating that said panel in said image area is to be replaced;

means for detecting presence of a run-out interval commencing with completion of image transfer from said image area and extending for at least the time for the last copy to exit the machine; and means responsive to said indicating means and said detecting means for actuating said successive panel advancing means.

2. An improved electrophotographic machine in accordance with claim 1 which includes means terminating operation of said successive panel advancing means when a new panel is in place in said image area.

3. An improved electrophotographic machine in accordance with claim 1 wherein said indicating means includes:

means for counting the number of copies made on the web panel in said image area; and means providing an enabling input to said run-out interval detecting means whenever the number of copies counted by said counting means exceeds a predetermined count.

4. An improved copier in accordance with claim 1 which includes:

means sensing said web advancing means is operational for a time period greater than a predetermined time period; and means responsive to said sensing means for indicating failure of proper advancement of said web.

5. In an electrophotographic copier having a photoconductor web mounted on a drum for transferring images from originals to copies, and means for presenting successive panels of the web, the improvement comprising:

means for counting the number of copies made by the copier since the last panel was presented;

means for detecting when the copier has completed transferring images but still operates to run out copies;

means advancing the photoconductor web during run-out, to present a portion of a new panel after a predetermined number of copies are made; and means terminating web advance when a new panel is completely presented.

6. An improved electrophotographic copier in accordance with claim 5 which includes means operable in response to operation of said advancing means for a time span greater than a predetermined time interval for indicating failure of proper advancement of said web.

7. An improved electrophotographic copier in accordance with claim 6 which includes:

means sensing that the web has moved a distance correlated to replacement of the web panel on the drum; and means responsive to said sensing means for indicating a successful panel replacement operation.

8. An improved electrophotographic copier in accordance with claim 7 which includes means responsive to said sensing means for disabling said failure indicating means.

9. In an electrophotographic copier having a drum with a mechanism within said drum selectively operable for moving a photoconductor web from a supply spool across an imaging area of said drum and onto a take-up spool, means for transferring images from said drum imaging area to copy sheets, and means processing said image bearing copy sheets for delivery to an exit tray, the improvement comprising:

means providing a signal indicative that the panel of said web in said imaging area requires replacement;

means detecting presence of a run-out interval commencing with completion of image transfer to a copy sheet and ending with delivery of said sheet to the exit tray;

means responsive to said signal providing means and said detecting means for operating said photoconductor web moving mechanism; and means measuring the amount of web dispensed by said moving mechanism for stopping said web dispensing mechanism when the photoconductor is completely replaced in the drum image area.

10. An improved electrophotographic copier in accordance with claim 9 wherein said signal providing means includes:

means counting the number of copies made since the last change of photoconductor on the drum image area for producing said panel replacement indicative signal when a predetermined copy count is reached; and means for resetting said counting means upon completion of each web panel replacement.

11. An improved electrophotographic copier in accordance with claim 10 which includes:

means sensing that the web dispensing mechanism has operated for a period in excess of that required to replace the photoconductor in the drum image area for indicating failure of proper web replacement.

12. In a copier that electrophotographically transfers images from an image area panel of a photoconductor to copy sheets and has a run-out period after said image transfer during which the copy sheet is processed and delivered to an exit tray and wherein said copier includes a photoconductor web dispensing mechanism capable of serially replacing the panel in the image area, the method of photoconductor image area panel replacement comprising the steps of:

determining that the photoconductor image panel requires replacement;

detecting that the run-out period has commenced;

actuating the photoconductor dispensing mechanism during the run-out period; and stopping the photoconductor dispensing mechanism when replacement of the photoconductor panel in the image area is complete.

13. The method in accordance with claim 12 wherein said determining step includes the steps of:

counting the number of copies made on the photoconductor panel in the image area; and enabling actuation of said photoconductor dispensing mechanism when the counted number at least equals a predetermined number.

* * * * *